US009777553B2

(12) United States Patent
Silva

(10) Patent No.: US 9,777,553 B2
(45) Date of Patent: Oct. 3, 2017

(54) USE OF SEGMENTED BALL SEAT AND ROTATIONAL LOCKING COLLET FOR FRAC BALL COUNTER

(71) Applicant: BAKER HUGHES INCORPORATED, Houston, TX (US)

(72) Inventor: Zachary S. Silva, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 496 days.

(21) Appl. No.: 14/560,002

(22) Filed: Dec. 4, 2014

(65) Prior Publication Data

US 2016/0160600 A1 Jun. 9, 2016

(51) Int. Cl.

| | |
|---|---|
| ***E21B 34/14*** | (2006.01) |
| *E21B 34/16* | (2006.01) |
| *E21B 34/00* | (2006.01) |

(52) U.S. Cl.

CPC ..... *E21B 34/14* (2013.01); *E21B 34/16* (2013.01); *E21B 2034/007* (2013.01)

(58) Field of Classification Search

CPC .... E21B 33/1292; E21B 33/12; E21B 33/124; E21B 43/26; E21B 43/25; E21B 34/14; E21B 2034/007

See application file for complete search history.

(56) References Cited

U.S. PATENT DOCUMENTS

2015/0267506 A1* 9/2015 Avery ..... E21B 33/124 166/373

FOREIGN PATENT DOCUMENTS

CA 2889268 A1 * 3/2014 ..... E21B 33/124
CA WO 2014043807 A1 * 3/2014 ..... E21B 33/124

* cited by examiner

*Primary Examiner* — Robert E Fuller
*Assistant Examiner* — David Carroll
(74) *Attorney, Agent, or Firm* — Mossman, Kumar & Tyler, PC

(57) ABSTRACT

An apparatus for performing a wellbore operation with a plug includes a plug seat assembly that has a plug seat having a plurality of seat segments, at least one seat segment having a plug seat rack, and each plug seat segment having an inner surface contacting the plug. The plug seat assembly also has a collet having a collet rack and a locking ratchet, the collet rack incrementally radially disengaging from the plug seat rack during relative rotation between the collet and the plug seat, and a mandrel having a mandrel rack complementary to the locking ratchet. The plug seat assembly is positioned in a wellbore and a plug radially displaces the at least one plug seat segment of the plug seat assembly.

22 Claims, 7 Drawing Sheets

USE OF SEGMENTED BALL SEAT AND ROTATIONAL LOCKING COLLET FOR FRAC BALL COUNTER

BACKGROUND OF THE DISCLOSURE

1. Field of the Disclosure

This disclosure relates generally to oilfield downhole tools and more particularly to methods and devices for targeting multiple stages of a wellbore for stimulation and production.

2. Description of the Related Art

As the oil and gas industry continues to explore and produce from wells that are deeper and more economically driven, designing downhole tools that can operate in sequential zone completion and intervention becomes a challenge. Ball operated frac sleeves are used to stimulate formation zones, where the ball size is incremented from the smallest ball operating the lower-most frac sleeve, to the largest ball size operating the upper-most frac sleeve. The incremental size difference of the frac balls limits the overall number of stages a ball operated completion system can be used in. The largest frac ball must be smaller than the tubing inner diameter, whereas each subsequently smaller frac ball must be incrementally smaller than the previous ball seat to be able to pass through the next stage. In such instances, the flowbore cross-sectional area is significantly reduced.

In some aspects, the present disclosure is directed to methods and devices for performing stimulation operations without compromising the flowbore cross-sectional area.

SUMMARY OF THE DISCLOSURE

In one aspect, the present disclosure provides a downhole tool having a plug seat assembly for performing a wellbore operation with a plug. The plug seat assembly may include a plug seat having a plurality of seat segments and a collet having a collet rack and a locking ratchet, the collet rack incrementally radially disengaging from the plug seat rack during relative rotation between the collet and the plug seat. At least one seat segment has a plug seat rack, each plug seat segment having an inner surface contacting the plug. The plug seat assembly also may include a mandrel having a mandrel rack complementary to the locking ratchet.

In another aspect, the present disclosure provides a downhole tool having a plug seat assembly for performing a wellbore operation with a plug. The plug seat assembly may include a plug seat having a plurality of arcuate seat segments and a tubular collet having an inner surface defining a bore having a first section and a second section. At least one arcuate seat segment has an inner radial surface and an outer radial surface. A plug seat rack and a locking profile are formed on the outer radial surface, and the inner radial surface is configured to receive the plug. A collet rack is formed on the inner surface defining the first bore section and a locking ratchet is formed on the inner surface defining the second bore section. The plug seat is disposed in the first section, and the collet rack is complementary with the plug seat rack. The plug seat assembly also may include a mandrel having a sleeve portion on which a mandrel rack complementary to the locking ratchet is formed. The sleeve is received into the second section bore, and the collet rack incrementally radially disengages from the plug seat rack during relative rotation between the collet and the plug seat.

In another aspect, the present disclosure provides a method for performing a wellbore operation. The method may include positioning a plug seat assembly in a wellbore.

Each plug seat assembly has a plug seat having a plurality of seat segments, at least one seat segment having a plug seat rack, each plug seat segment having an inner surface. Each plug seat assembly may also include a collet having a collet rack and a locking ratchet, the collet rack incrementally radially disengaging from the plug seat rack during relative rotation between the collet and the plug seat, and a mandrel having a mandrel rack complementary to the locking ratchet. The method may also include radially displacing the at least one plug seat segment of the plug seat assembly with a plug.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1A:
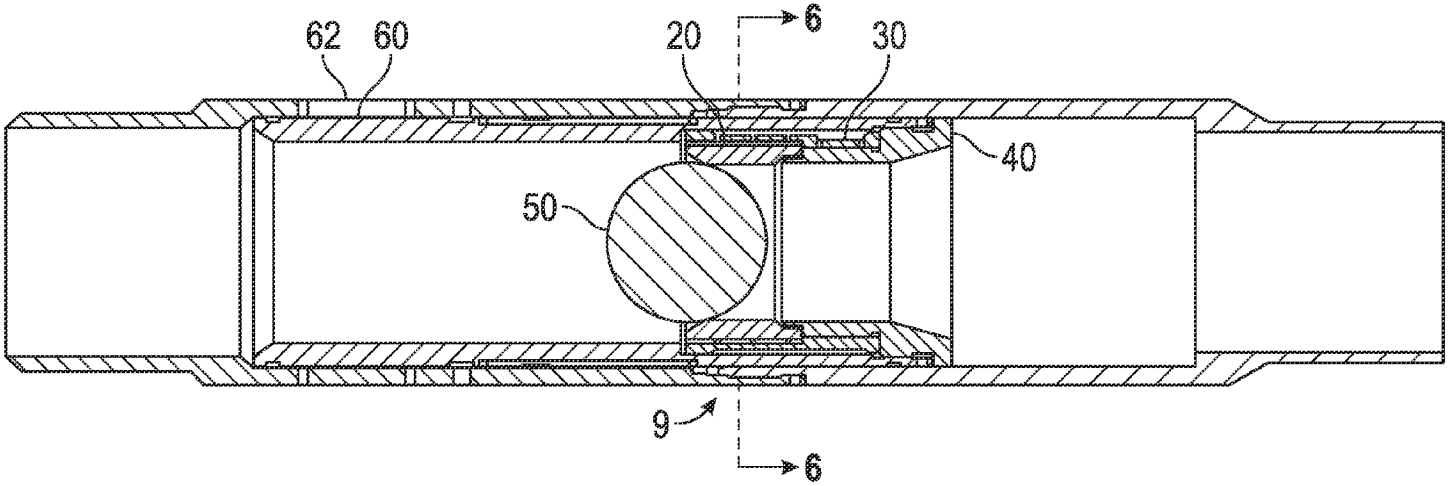
FIG. 1A shows an exemplary plug seat assembly according to the present disclosure before a plug passes through the plug seat assembly.

The present disclosure relates to devices and methods for well stimulation operations using a segmented plug seat assembly. The plug seat assembly uses radially expanding seating elements and circumferentially oriented locking components to enable multiple instances of the same size plug use. That is, there is no need of an incremental decrease in plug size. Eliminating a decrease in plug size leaves a larger flow bore to pump the stimulation fluids, which enables more effective stimulation operations. Further, employing circumferentially locking components instead of axially stroking locking components can shorten the tool size.

FIG. 1A-D shows one non-limiting embodiment of a plug seat assembly 9 used in connection with a well stimulation tool. The plug seat assembly 9 may be run in on a casing, liner, tubing, coiled tubing or other suitable wellbore tubular. The plug seat assembly 9 may include a plug seat 20, a tubular collet 30, and a mandrel 40. The plug seat 20 radially expands and retracts to allow selective passage of a plug 50. The radial motion is controlled by the tubular collet 30, which incrementally rotates around a longitudinal axis, and the mandrel 40. Once the preset number of plugs 50 passes through the plug seat assembly 9, the tubular collet 30 stops rotating and keeps the plug seat 20 from expanding radially. Therefore, the next plug 50 lands and stays on the plug seat assembly 9 due to the plug seat 20 being stopped from further radial motion.

FIG. 1A shows the plug seat assembly 9 disposed in a tubing 60. The plug 50, which is dropped from the surface and pumped downhole, lands on the plug seat 20. The plug seat 20 has an opening to receive a plug 50. When the plug seat 20 is in a retracted state, the plug 50 seats in and seals the opening. When the plug seat 20 is in an expanded state, the plug 50 passes through the opening. The opening can be shaped complementary to the plug 50; e.g., a circular shape.

Figure 2:
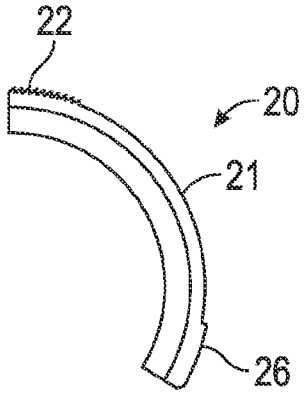
FIG. 2 shows an exemplary seat segment for the FIG. 1A embodiment.

The plug seat 20 is composed of arcuate seat segments 21 as shown in FIG. 2. The seat segments 21 individually or collectively move radially in order to allow the plug 50 to either pass through or seal the opening of the plug seat 20. Each arcuate seat segment 21 has a plug seat rack 22 and a locking profile 26. As used herein, a "profile" is surface that has contours, edges, projections, recesses, and/or other structural features. Illustrative profiles include, but are not limited to, shoulders, notches, grooves, cavities, etc. As shown, the plug seat rack 22 and the locking profile 26 can be located on the opposite ends of the arcuate seat segment 21. The locking profile 26 and the plug seat rack 22 can be in any configuration related to each other on the arcuate seat segment 21. The plug seat rack 22 may be a circumferential strip of jagged teeth. The locking profile 26 may be a raised surface or projection. The plug seat rack 22 and the locking profile 26 can be located on the outer radial surface of the plug seat 20.

In one embodiment, the plug seat 20 may be rotationally fixed to the mandrel 40. In another embodiments, the plug seat 20 may be fixed to an adjacent structure. In either instance, the plug seat segments 21 remain sufficiently stationary so that the collet 30 can rotate relative to the seat 20 and push against the plug seat segments 21.

Figure 3A:
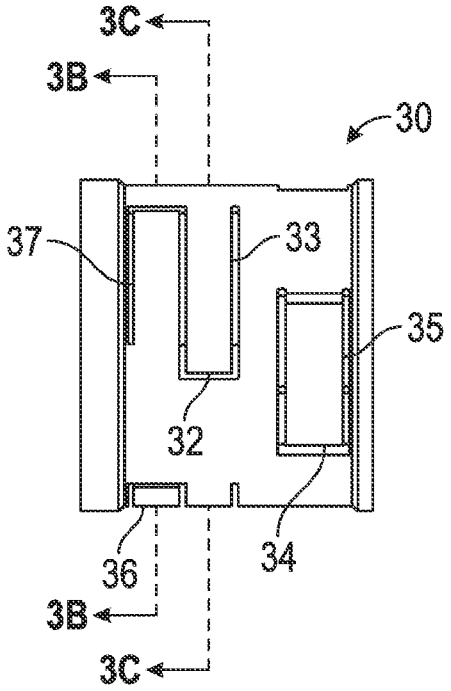
FIG. 3A-C show an exemplary collet and the cross-sections of the collet that may be used with the FIG. 1A embodiment.
Figure 3B:
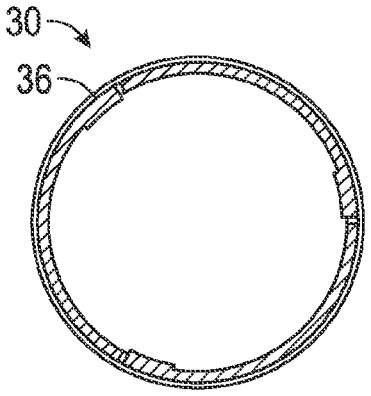
Figure 3C:
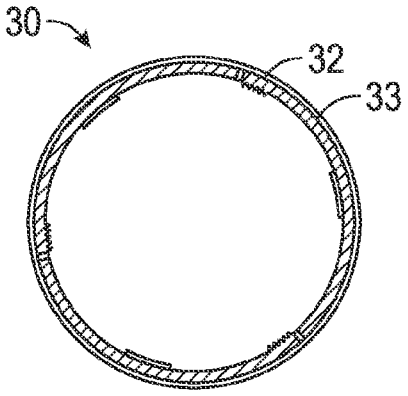

FIG. 3A-C depict a front view and two cross-sections of the collet 30, respectively. The collet 30 can be a hollow cylinder with a bore that has two sections: the first section and the second section. The plug seat 20 can be disposed inside the first section and the mandrel 40, which may be a tubular element, is received inside the second section. The first section can have an inwardly projecting detent 36 located towards the free end of a collet finger 37. The number of detents 36 can match the number of the locking profiles 26 of the plug seat 20. The collet finger 37 is a resilient element that allows the detent 36 to be pushed radially out by the plug seat 20 when the plug seat 20 radially expands out.

Figure 4:
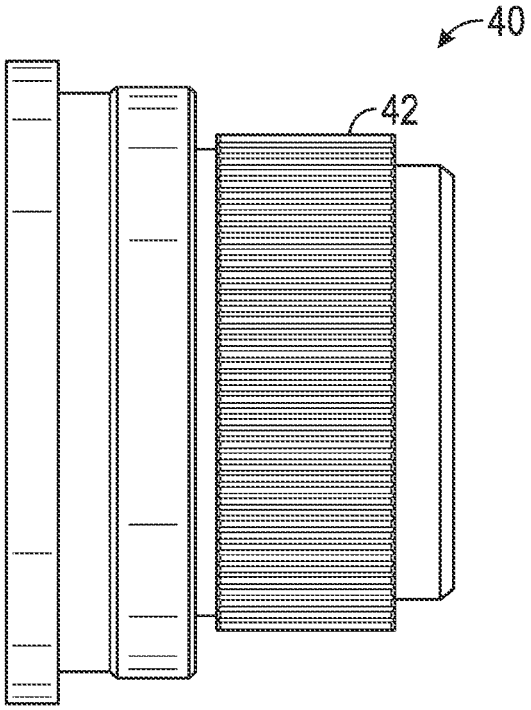
FIG. 4 shows an exemplary mandrel that may be used with the FIG. 1A embodiment.

The first section of the collet 30 can also have the collet rack 32 positioned towards the free end of a collet finger 33. The collet rack 32 can have a set or strip of jagged teeth matching the jagged teeth of the plug seat rack 22. The second section of the collet 30 can have a locking rack 34 on a collet finger 35. The locking ratchet 34 has jagged teeth that can receive a mandrel rack 42 (FIG. 4) that is located on the mandrel 40. The co-action of collet rack 32 and the plug seat rack 22 and the co-action of the locking rack 34 and the mandrel rack 42 allow rotation of the collet 30 in a direction that closes the distance between the locking profile 26 of the plug seat elements 21 and the detent 36 of the collet 30.

Figure 5:
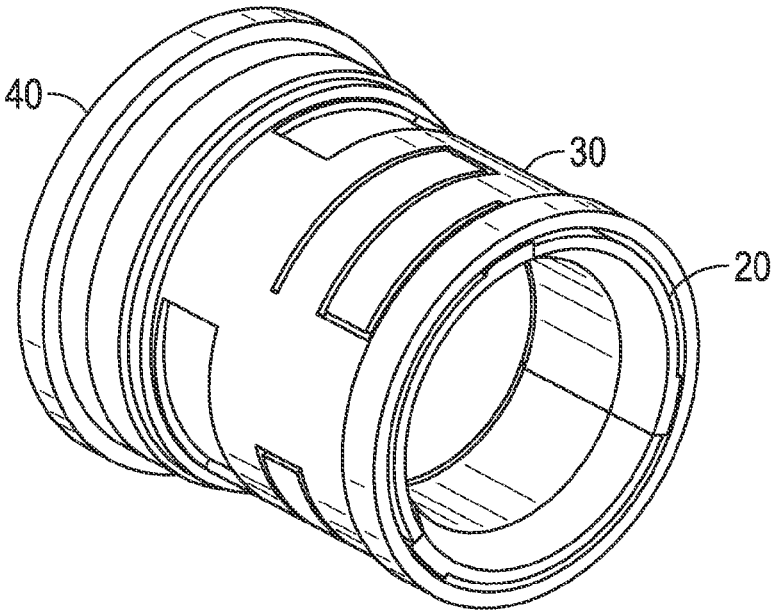
FIG. 5 shows an exemplary assembly of the seat segments, a collet and a mandrel.
Figure 6:
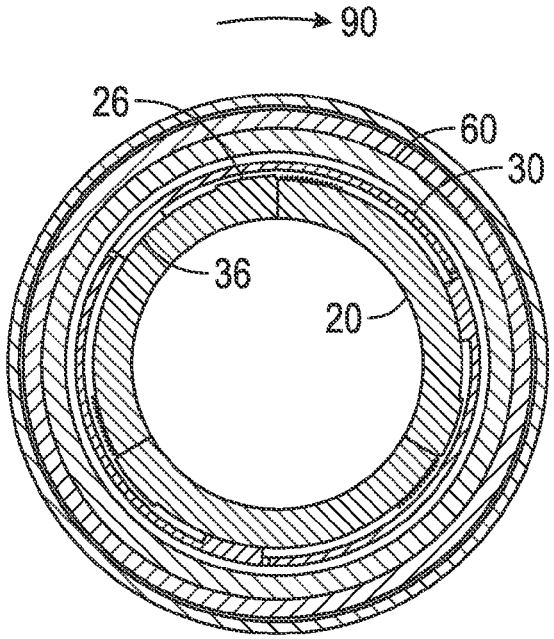
FIG. 6 shows a radial cross-section of an exemplary plug seat assembly at an initial position.
Figure 7:
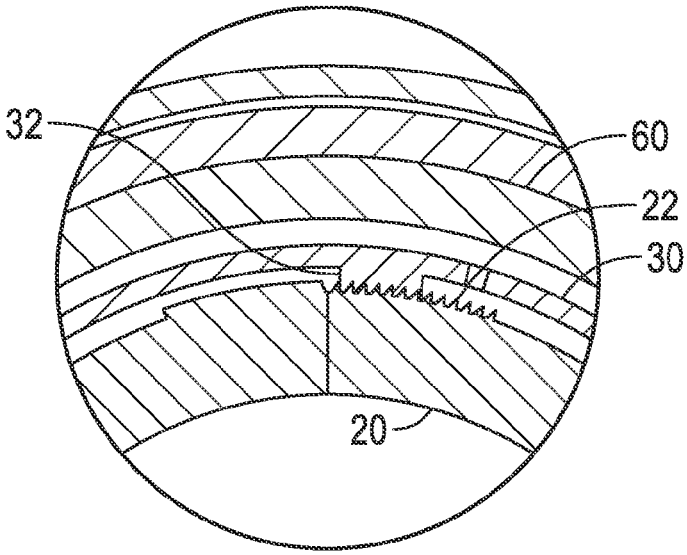
FIG. 7 shows an exemplary ratchet mechanism of a plug seat assembly in a detailed view.

FIG. 5 shows the plug seat 20, the collet 30 and the mandrel 40 in an assembled condition. In a pre-activated state, the locking profile 26 of the plug seat 20 is at a preset angular distance away from the detent 36 of the collet 30 as shown in FIG. 6. FIG. 7 shows an engagement of the ratchet mechanism formed by the plug seat rack 22 and the collet rack 32.

Figure 1B:
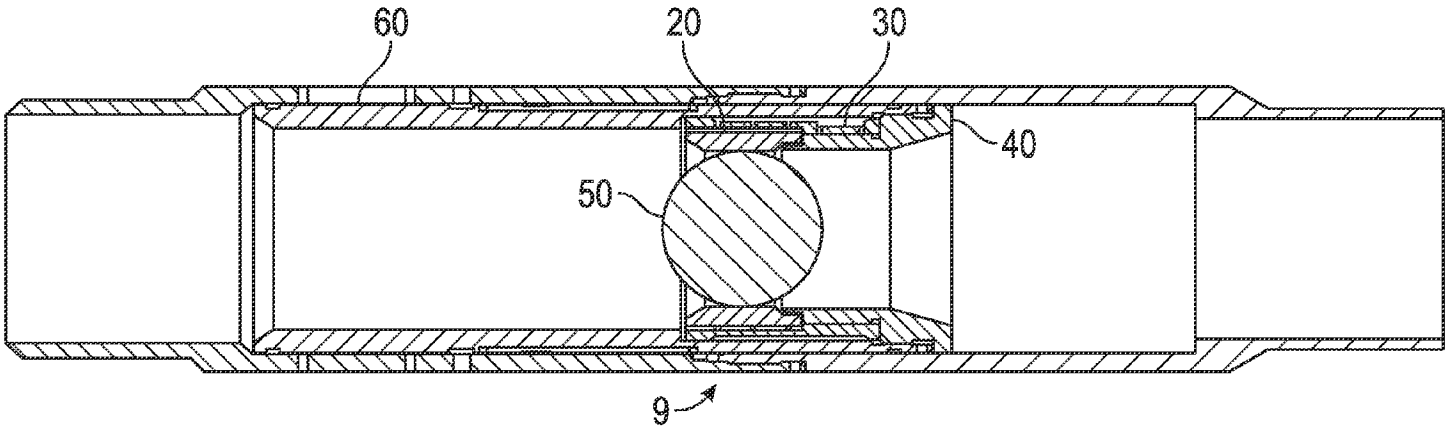
FIG. 1B shows the FIG. 1A embodiment as a plug passes through the plug seat assembly.
Figure 1C:
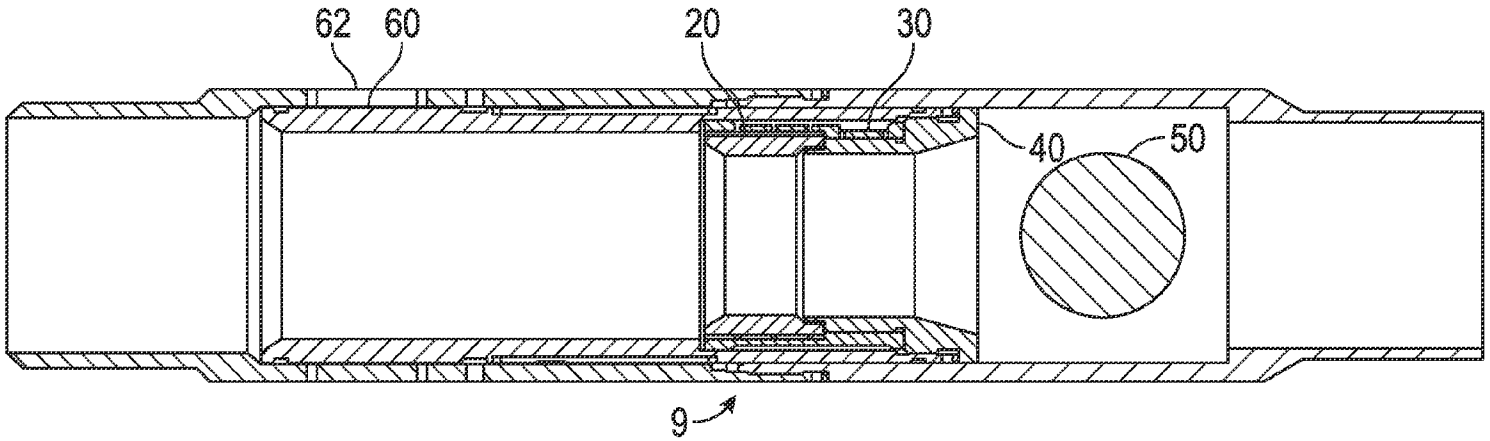
FIG. 1C shows the FIG. 1A embodiment after a plug passes through the plug seat assembly.

In operation, a plug 50 is dropped into the wellbore from the surface. Pressurized fluid moves the plug 50 until the plug 50 lands on the plug seat 20 as shown in FIG. 1A. The pressurized fluid forces the plug 50 against the plug seat 20 and the pushes the plug seat segments 21, which causes the plug seat elements 21 to move radially outward as shown in FIG. 1B. The plug seat 20 expands and advances a tooth of the locking ratchet 34 with respect to the mandrel rack 42. Advancing a tooth requires the rotation of the collet 30 in a direction 90 with respect to the mandrel 40. After the plug 50 passes, the collet fingers of the collet 30 pushes the plug seat 20 radially inward back to its initial position as shown in FIG. 1C, which prevents any further rotation of the collet 30. The mandrel rack 42 prevents collet 30 from rotating in an opposite direction of the direction 90, resulting in the advancement of one tooth of the collet rack 32 with respect to the plug seat rack 22 when the plug seat 20 travels radially inward to its initial position.

Figure 8A:
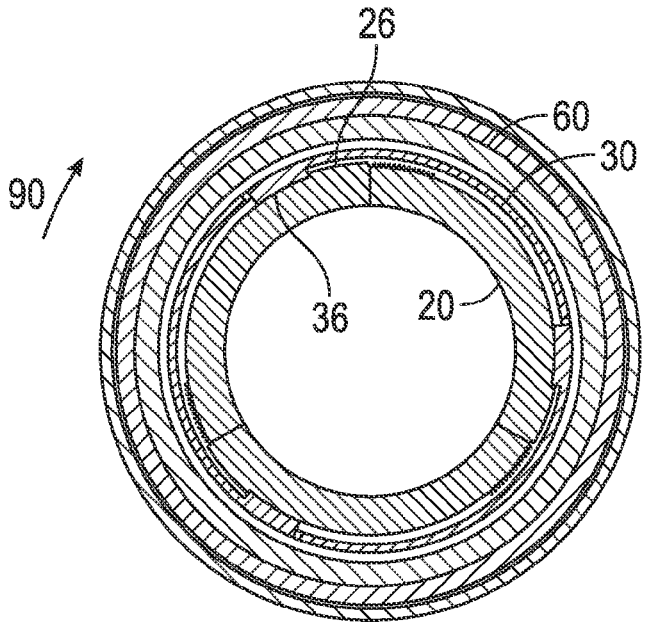
FIG. 8A shows a radial cross-section of an exemplary plug seat assembly as a plug seat is locked.
Figure 8B:
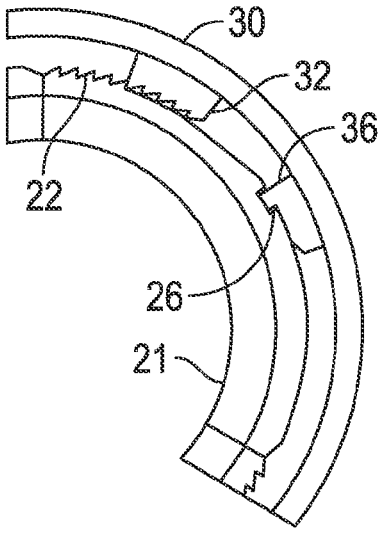
FIG. 8B shows an exemplary detent and locking profile of a plug seat assembly as a plug seat is locked.
Figure 9A:
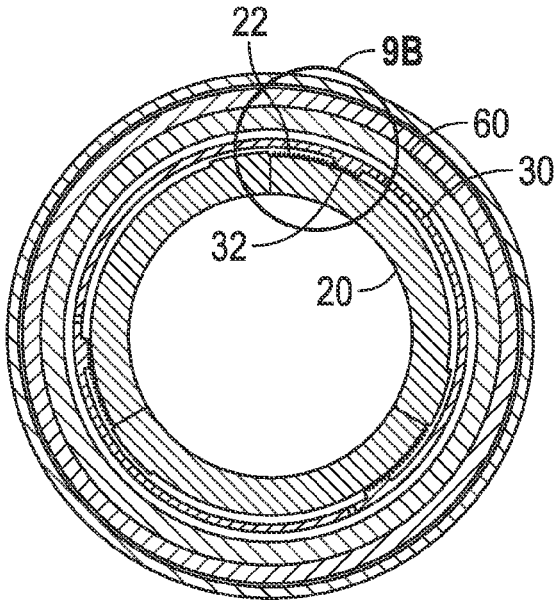
FIG. 9A shows a radial cross-section of an exemplary plug seat assembly as a plug seat is locked.
Figure 9B:
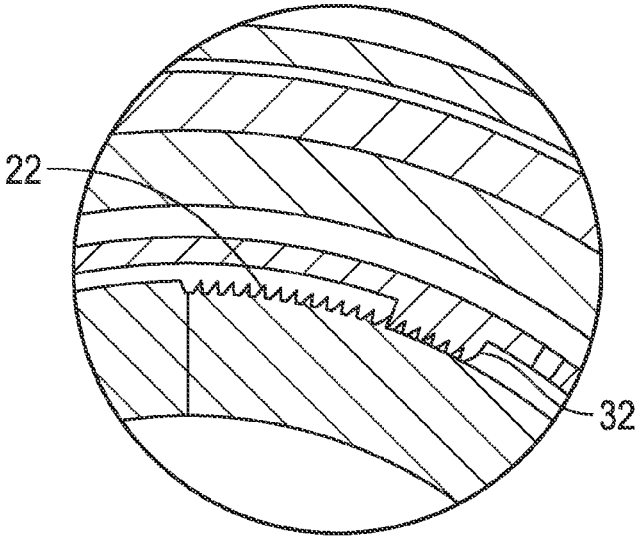
FIG. 9B shows an exemplary ratchet mechanism of a plug seat assembly in a detailed view as a plug seat is locked.

FIG. 8A depicts an axial cross-section of the plug seat assembly 9 after a predetermined number of plugs 50 have passed. The detent 36 of the collet 30 rests on the locking profile 26 of the plug seat 20 (FIG. 8B) preventing further rotation of the collet 30 in the direction 90. In FIG. 8B, the locking profile 26 is shown as a notch, however, other locking profiles 26 can be used. Since the collet 30 cannot rotate, the collet fingers 33, 35 cannot extend out and allow the tooth of the plug seat rack 22 to advance. Also, the collet fingers 33, 35 cannot extend out to allow the plug seat segments 21 to radially expand outward. FIG. 9A and FIG. 9B show a radial cross-section and a detailed view of the plug seat assembly 9 as the plug seat rack 22 and the collet rack 32 at its configured final position, respectively.

Figure 1D:
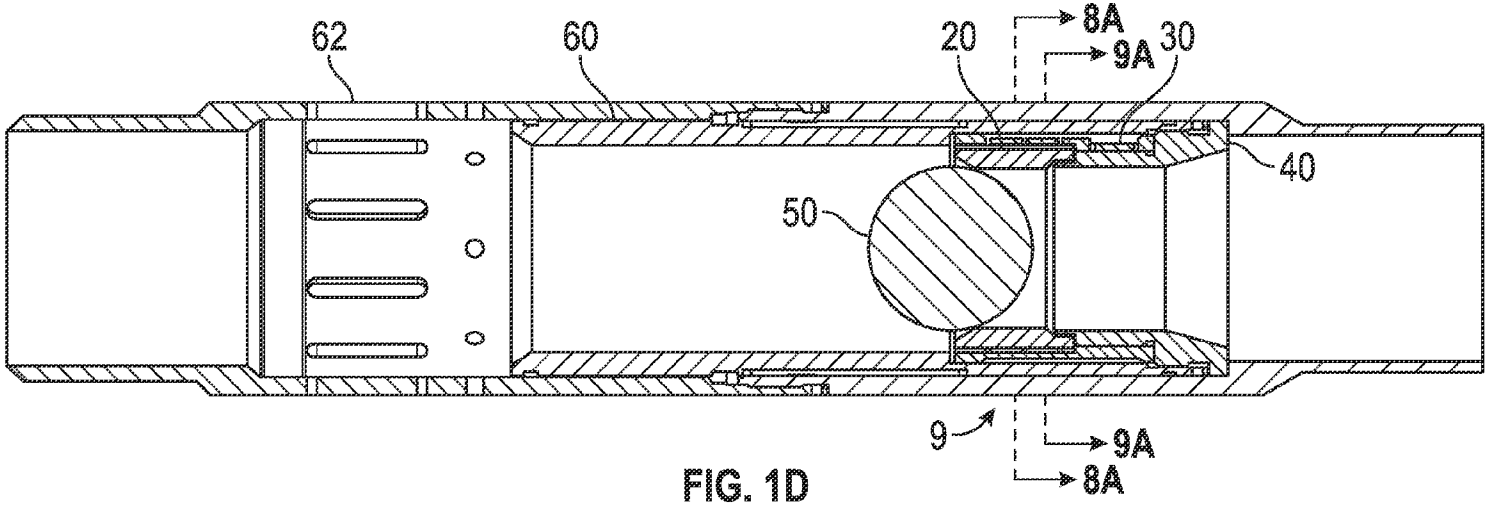
FIG. 1D shows the FIG. 1A embodiment as a plug seat is locked.

As shown in FIG. 1D, when the plug seat 20 does not expand, the plug 50 landed on the plug seat 20 seals the tubular. The tubular can be pressurized with pumped fluid. The pressurized fluid in the tubular strokes a tubing 60 and opens the one or more axially spaced-apart openings 62 located adjacent to the ball seat assembly. The plug 50 sealing a downhole side of the plug seat assembly 9 directs the fluid through the ports into the formation. The fluid exits the tubular 60 through the openings 62.

It should be appreciated that the teachings of the present disclosure provide flexibility for well operations. Merely by way of example, a well may have four pay zones. Each zone may have a plug seat assembly. The first, or furthermost uphole, plug seat assembly may be configured to have three plugs pass through. The second plug seat assembly, which is immediately downhole of the first plug seat assembly, may be configured to have two plugs pass through. The third plug seat assembly, which is immediately downhole of the second plug seat assembly, may be configured to have one plug pass through. The fourth lowermost zone may have a conventional plug seat assembly, which does not have radially moving plug seat segments.

In this non-limiting arrangement, pumping a first plug down will seal the fourth plug seat assembly. Thus, a well operation, such as stimulation, can be performed at the fourth zone. The movement of the first plug will also incrementally move the collets of each of the first three plug seat assemblies. Pumping a second plug down will seal the third plug seat assembly because it was configured to allow only one plug to pass through. Now, a well operation, such as stimulation, can be performed at the third zone without affecting the fourth zone. In like fashion, the remaining plug seat assemblies may be sealed to perform operations at the second and first zone.

It should be understood that the teachings of the present disclosure are susceptible to numerous embodiments and variants. Certain non-limiting embodiments and variations of the plug seat assembly 9 will be discussed below.

In another embodiment, the mandrel 40 may be coupled to the outer surface of the collet 30. In that case, the locking ratchet 34 may be located on the outer surface of the collet 30, and the mandrel 40 may mount on the outer surface of the collet 30. Then, the mandrel 40 may have the mandrel rack 42 on its inner side. Also, the collet fingers 33, 35, 37 located on the collet 30 may be recessed with respect to the outer surface of the collet 30 depending on the thickness and flexibility needs. The plug seat 20 may be on the downhole side of the mandrel 40.

The plug seat 20 may include only one seat segment 21 that moves radially or have two or more seat segments 21 that expand radially outward to allow the plug 50 to pass. Also, the seat segments 21 may be segments of a tubular body such as a sleeve, a hollow cylinder or a collet. Thus, the seat segments 21 may be discrete and separate elements or features formed in an integral body.

When the plug seat rack 22 advances a tooth with respect to the collet rack 32, the mandrel rack 42 may advance a tooth with respect to the locking ratchet 34. Or, each tooth advancement of the plug seat rack 22 may correspond to a multiple teeth advancement of the mandrel rack 42. In another embodiment, the mandrel rack 42 and the locking ratchet 34 may be eliminated. In that case, the plug seat rack 22 and the collet rack 32 combination may be the only mechanism that allows incremental rotation in the direction 90 and prevents the rotation in the opposite direction. In an embodiment, other biasing members such as springs with dogs, leaf springs or radial springs can be used instead of collet fingers 33, 35, 37 that snap the ball seat segments 21 radially inwards. Also, the plug seat rack 22, the collet rack 32, the locking ratchet 34 or the mandrel rack 42 may be a pawl or have a single tooth.

In a variation, the well may have several production zones. Each zone may have a plug seat assembly 9 located adjacent to it. Then, each plug seat assembly 9 may be configured to pass one more plug 50 than the plug seat assembly 9 located in the next downhole zone. In addition, the well may have different plug seat assemblies 9 with differing plug seat 20 inner surface profiles. The well stimulation operations can be fracing, acidizing, fluid injection, well intervention or other wellbore operations. Also, the plugs 50 may be balls, wiper plugs or other shapes that can engage the plug seat 20 to isolate the downhole side of the plug seat assembly 9 from the uphole side. The plug seat 20 may have an inner profile different than a circular shape.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

In a variation, the plug seat assembly 9 may be connected to a consumer such as a packing element, a liner hanger, a slip assembly, a cone, and/or an expandable. As the plug seat assembly 9 strokes, the consumer may be actuated.

The foregoing description is directed to particular embodiments of the present disclosure for the purpose of illustration and explanation. It will be apparent, however, to one skilled in the art that many modifications and changes to the embodiment set forth above or embodiments of different forms are possible without departing from the scope of the disclosure. It is intended that the following claims be interpreted to embrace all such modifications and changes.

I claim:

1. An apparatus for performing a wellbore operation with a plug, comprising:

a plug seat assembly having:

a plug seat having a plurality of arcuate seat segments, at least one arcuate seat segment having an inner radial surface and an outer radial surface, wherein a plug seat rack and a locking profile are formed on the outer radial surface, and wherein the inner radial surface is configured to receive the plug;

a tubular collet having an inner surface defining a bore having a first section and a second section, wherein a collet rack is formed on the inner surface defining the first bore section and a locking ratchet is formed on the inner surface defining the second bore section, wherein the plug seat is disposed in the first section and the collet rack is complementary with the plug seat rack; and a mandrel having a sleeve portion on which a mandrel rack complementary to the locking ratchet is formed, wherein the sleeve is received into the second section bore, wherein the collet rack incrementally radially disengages from the plug seat rack during relative rotation between the collet and the plug seat.

2. An apparatus for performing a wellbore operation with a plug, comprising:

a plug seat assembly having:

a plug seat having a plurality of seat segments, at least one seat segment having a plug seat rack, each plug seat segment having an inner surface contacting the plug;

a collet having a collet rack and a locking ratchet, the collet rack incrementally radially disengaging from the plug seat rack during relative rotation between the collet and the plug seat; and a mandrel having a mandrel rack complementary to the locking ratchet.

3. The apparatus of claim 2, wherein at least one plug seat segment moves radially to disengage plug seat rack and the collet rack.

4. The apparatus of claim 3, wherein the collet rotates when the at least one plug seat segment moves radially.

5. The apparatus of claim 2, wherein the plurality of seat segments are axially stationary with respect to the mandrel.

6. The apparatus of claim 2, wherein the plug seat rack is formed on an outer radial surface of the at least one plug seat segment and the collect rack is formed on an inner radial surface of the collet, and wherein the plug seat rack and the collet rack include mating engagement elements.

7. The apparatus of claim 6, wherein the mating engagement elements are oriented for uni-directional movement.

8. The apparatus of claim 2, wherein the at least one seat segment further includes a locking profile and the collet further includes a detent, wherein the locking profile rotates into engagement with the detent to prevent further relative rotational movement between the collet and the plug seat.

9. The apparatus of claim 8, wherein the locking profile is a raised surface on an outer surface of the ball seat and the detent is a raised head on an inner surface of the collet.

10. The apparatus of claim 8, wherein the collet includes a biasing member on which the detent is located, and wherein the collet rack is coupled to one of (i) a collet finger, (ii) leaf spring, and (iii) radial spring.

11. The apparatus of claim 2, wherein the mandrel includes a sleeve portion having an outer radial surface on which the mandrel rack is formed, and wherein the collet has an inner surface on which the locking ratchet is formed, and wherein the mandrel rack and the locking ratchet include mating engagement elements.

12. The apparatus of claim 2, wherein the mandrel includes a sleeve portion having an inner radial surface on which the mandrel rack is formed, and wherein the collet has an outer surface on which the locking ratchet is formed, and wherein the mandrel rack and the locking ratchet include mating engagement elements.

13. The apparatus of claim 2, wherein mandrel rack and the locking ratchet incrementally radially disengage when the at least one plug seat segment moves radially to disengage plug seat rack and the collet rack.

14. The apparatus of claim 2, wherein:

the mandrel includes a sleeve portion having an outer radial surface on which the mandrel rack is formed, wherein the collet includes a first bore section receiving the plug seat and a second bore section receiving the sleeve.

15. The apparatus of claim 8, further comprising a plurality of plug seat assemblies and a plurality of stimulation zones wherein each plug seat assembly is adjacent to a stimulation zone, and wherein the number of plugs each plug seat assembly allows to pass is equal to a multiple of mating engagement elements that fit into the circumferential distance between the locking profile and the dent of that plug seat assembly.

16. A method for performing a wellbore operation, comprising:

positioning a plug seat assembly in a wellbore, each plug seat assembly having:

a plug seat having a plurality of seat segments, at least one seat segment having a plug seat rack, each plug seat segment having an inner surface;

a collet having a collet rack and a locking ratchet, the collet rack incrementally radially disengaging from the plug seat rack during relative rotation between the collet and the plug seat; and a mandrel having a mandrel rack complementary to the locking ratchet; and radially displacing the at least one plug seat segment of the plug seat assembly with a plug.

17. The method of claim 16, wherein radially displacing the at least one plug seat segment causes:

a rotation of the collet;

the disengagement of the plug seat rack from the collet rack; and the disengagement of the locking ratchet from the mandrel rack.

18. The method of claim 17, further comprising forcing the plug through the plug seat using a fluid pressure, wherein the plug seat retreats after the plug passes through.

19. The method of claim 17, further comprising preventing the rotation of the collet after a preset angular rotation by engaging a locking profile of the plug seat with a detent of the collet.

20. The method of claim 17, wherein the plug seat rack and the collet rack include mating engagement elements, and further comprising advancing one mating engagement element of the plug seat with respect to the collet rack to disengage the plug seat rack from the collet rack.

21. The method of claim 16, further comprising positioning a plurality of plug seat assemblies in the wellbore wherein each plug seat assembly is located at a different zone.

22. The method of claim 16, further comprising performing a well treatment operation, wherein the well treatment operation is at least one of: (i) a hydraulic fracturing operation, (ii) a well stimulation operation, (iii) a well tracer injection operation, and (iv) a well cleaning operation.

* * * * *